United States Patent [19]

Baxter

[11] Patent Number: 4,753,360

[45] Date of Patent: Jun. 28, 1988

[54] CONTAINER CLOSURE

[75] Inventor: Alan A. Baxter, Colchester, United Kingdom

[73] Assignee: National Plastics Limited, United Kingdom

[21] Appl. No.: 96,939

[22] Filed: Sep. 15, 1987

[30] Foreign Application Priority Data

Sep. 16, 1986 [GB] United Kingdom ..... 8622252

[51] Int. Cl.[4] ..... B65D 41/34

[52] U.S. Cl. ..... 215/252

[58] Field of Search ..... 215/252, 253, 256

[56] References Cited

U.S. PATENT DOCUMENTS

| | | | |
|---|---|---|---|
| 4,147,268 | 4/1979 | Patel et al. . | |
| 4,156,490 | 5/1979 | Peraboni | 215/252 |
| 4,305,516 | 12/1981 | Perne et al. | 215/252 |
| 4,380,299 | 4/1983 | Llera | 215/252 |
| 4,530,438 | 7/1985 | McDevitt | 215/252 |
| 4,555,039 | 11/1985 | Conti | 215/252 |

FOREIGN PATENT DOCUMENTS

| | | | |
|---|---|---|---|
| 0094026 | 11/1983 | European Pat. Off. | 215/252 |
| 154603 | 1/1985 | European Pat. Off. . | |
| 756503 | 9/1956 | United Kingdom . | |
| 809398 | 2/1959 | United Kingdom . | |
| 1054308 | 6/1964 | United Kingdom . | |
| 1531783 | 11/1978 | United Kingdom . | |
| 2096110 | 10/1982 | United Kingdom . | |

*Primary Examiner*—Stephen Marcus
*Assistant Examiner*—Nova Stucker
*Attorney, Agent, or Firm*—Emrich & Dithmar

[57] ABSTRACT

A closure for a container, includes a tamper-indicating band (11) with internal protrusions (22) for engagement under a bead on a container to prevent removal of the closure from the container after application thereto without breaking the tamper-indicating band (11). Each internal protrusion on the tamper-indicating band (11) comprises an elongated, inward projection (22) extending in a general direction around the band (11) and having a longitudinal axis inclined to the circumferential direction of the band (11) at a small angle so that each projection (22) has a helical configuration in relation to the tamper-indicating band (11). The leading end (29) of each projection (22) as determined by the action of screwing the closure onto a container, merges smoothly with the immediately preceding part (23) of the tamper-indicating band (11) and increases gradually and smoothly in height in a rearward direction. Each projection (22) has a downward extension (24) with a smooth, outwardly and downwardly inclined surface (25), extending to, or close to, the lower rim (19) of the tamper-indicating band (11).

10 Claims, 3 Drawing Sheets

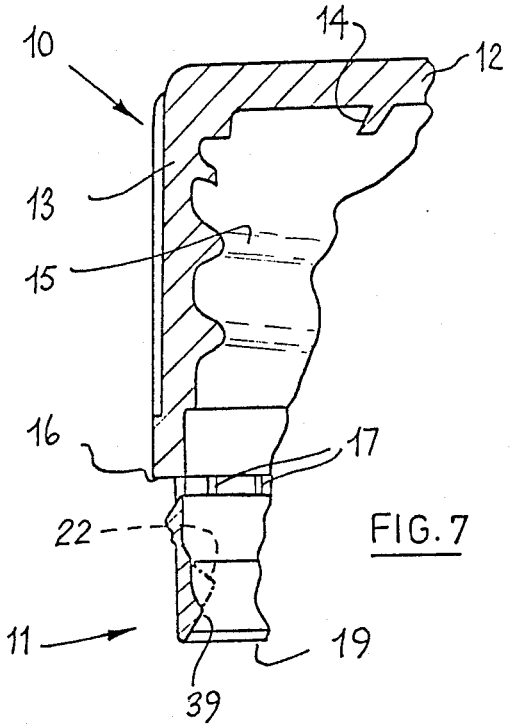
FIG. 7
FIG. 8
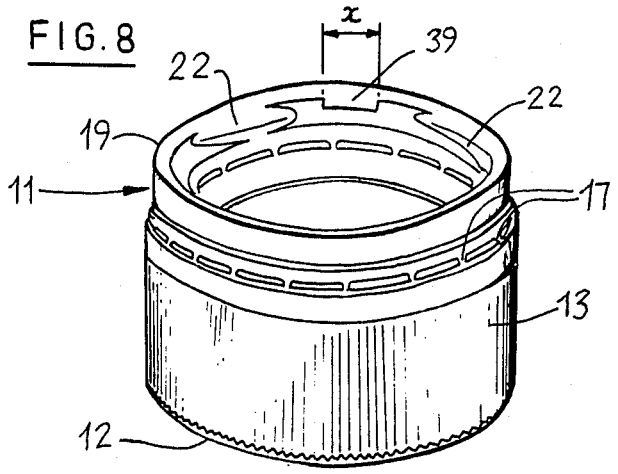

CONTAINER CLOSURE

TECHNICAL FIELD

This invention relates to a closure for a container, for example a bottle, such as those suitable for containing soft drinks.

DISCUSSION OF PRIOR ART

It is increasingly desirable to provide such a closure with a tamper-indicating band which, after the closure has been applied to a container, will prevent its removal without breaking the band and/or its attachment to the closure so that the first removal of the closure is clearly indicated.

Such a closure is described in European Patent Specification, Publication No. 154,603, in which interengagement of the tamper-indicating band with a bead on a container neck is achieved by means of an inwardly projecting rib on the band, which has a smaller inner diameter than the outer diameter of the bead on the container, and by projections formed as additional protrusions on the rib and extending inwardly of the closure further beneath the bead on the container than the rib, in order to provide secure engagement of the tamper-indicating band with the container after the closure has been applied thereto.

Thus, European Patent Specification No. 154,603 describes a closure for an externally screw-threaded container, the closure having a screw-thread on the interior surface of a sidewall for engagement with the screw-thread on the container and also having a tamper-indicating band attached to the lower rim of the sidewall, the band being provided internally with a plurality of spaced apart protrusions in the vicinity of its lower rim for engagement under a bead on the container to prevent removal of the closure from the container after application thereto, without breaking the tamper-indicating band and/or detaching the band from the sidewall.

SUMMARY OF THE INVENTION

According to the invention, in a closure of the kind just described, each internal protrusion on the tamper-indicating band comprises an elongated, inward projection extending in a general direction around the band and having a longitudinal axis inclined to the circumferential direction of the band at a small angle, so that each projection has a helical configuration in relation to the tamper-indicating band, the leading end of each projection, as determined by the action of screwing the closure onto a container, merging smoothly with the immediately preceding part of the tamper-indicating band and increasing gradually and smoothly in height in a rearward direction, each projection having a downward extension with a smooth, outwardly and downwardly inclined surface, extending to, or close to, the lower rim of the tamper-indicating band.

The inward projections may be formed on an internal strengthened rib on the tamper-indicating band, but the inner diameter of the rib preferably has a diameter equal to, or greater than, the largest diameter of the bead on the container so that the rib does not engage under the bead when the closure is applied to the container.

The lower rim of the tamper-indicating band is preferably internally chamfered so that its inner surface extends upwardly and inwardly from the lowermost, inner extremity of the tamper-indicating band and the chamfer surface merges with the surfaces of the lower parts of the downward extensions of the said projections.

Desirably, between each pair of protrusions on the tamper-indicating band is located an inwardly extending lug of smaller depth than the protrusions and arranged, during removal of the closure from the container to which it is intended to be fitted, so that it engages the bead on the container and supports the tamper-indicating band against distortion.

BRIEF DESCRIPTION OF THE DRAWINGS

The invention will be further described, by way of example, with reference to the accompanying drawings, in which:

FIG. 7 is a partial longitudinal section through a second embodiment of closure according to the invention, and FIG. 8 is a perspective view of the second embodiment of closure partially shown in FIG. 7.

DESCRIPTION OF PREFERRED EMBODIMENTS

Figure 1:
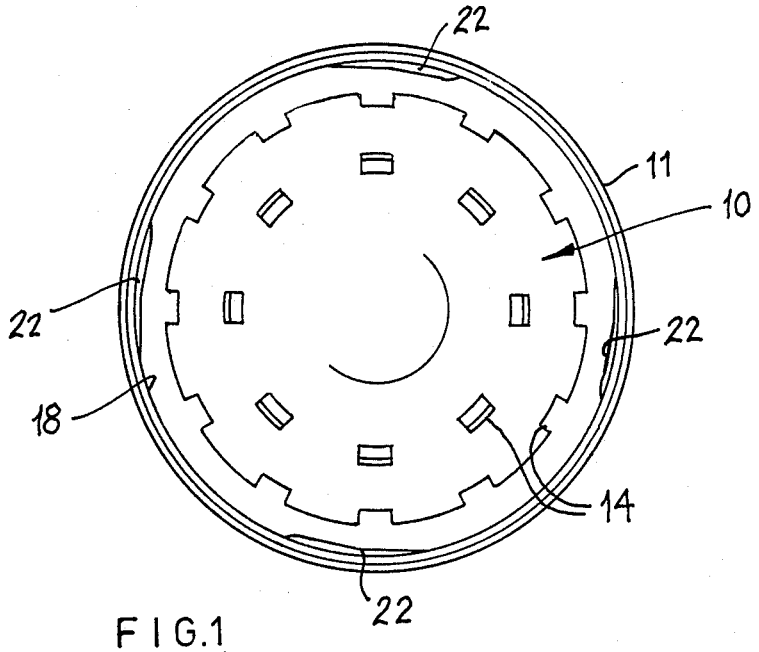
FIG. 1 is a plan of a first embodiment of closure according to the invention looking down on the open end of the closure.
Figure 2:
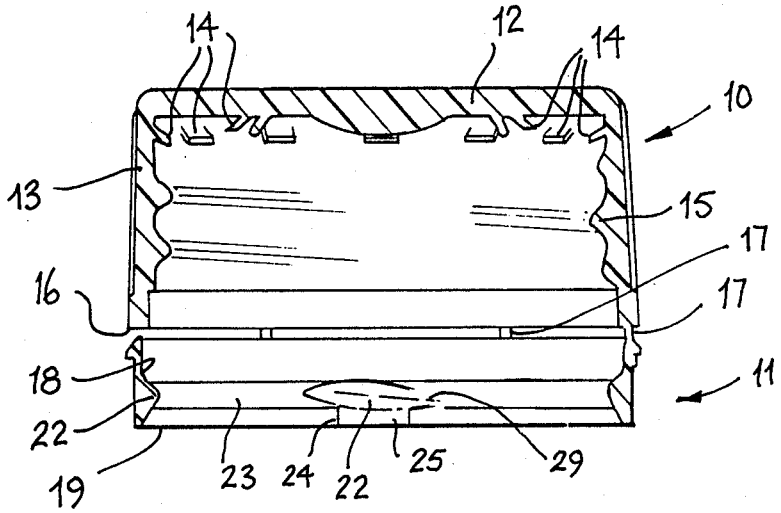
FIG. 2 is a longitudinal section through the closure of FIG. 1.
Figure 3:
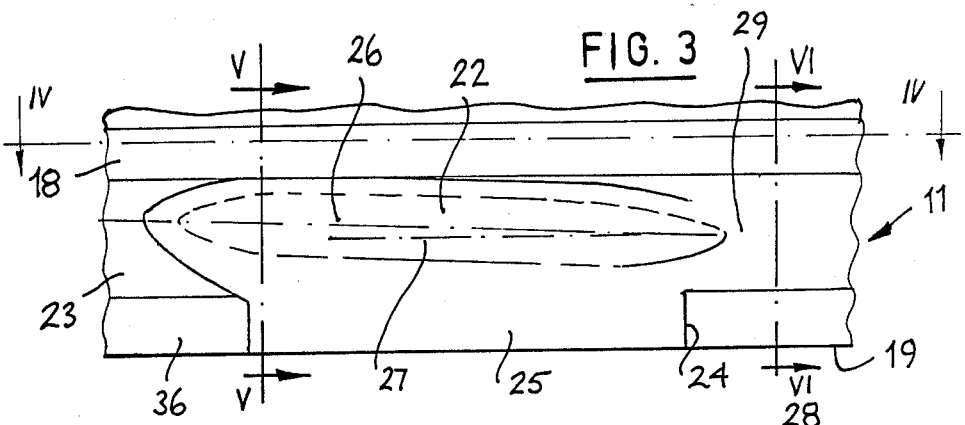
FIG. 3 is a view on an enlarged scale, from inside the closure of FIG. 1, of an internal projection on the tamper-indicating band of the closure.

The closure shown in FIGS. 1 to 6 is injection moulded in one piece from synthetic plastics material (for example, polyethylene or polypropylene) and comprises a cap 10 and a tamper-indicating band 11. The cap 10 comprises an end wall 12 and a cylindrical sidewall 13. The end wall 12 has formations 14 on its inner surface, which cooperate with gasket material flowed into the cap 10, so as to retain the gasket material, when solidified, in the cap so that it can form a sealing conjunction with the mouth of a container. The interior surface of the sidewall 13 carries a screw-thread 15 for engagement with a screw-thread on a container.

The tamper indicating band 11 is attached to the lower rim 16 of the sidewall 13 by connecting bridges 17 located at intervals around the circumference of the sidewall. In the closure of FIGS. 1 to 6 six breakable bridges 17 are provided, but the number may be smaller or greater. One or more of the bridges 17 may be made stronger than the other bridges 17 so that on removing the closure from a container to which it has been applied, the weaker bridges 17 and the band 11 will break but the stronger bridge or bridges 17 will ensure that the broken band 11 remains attached to the sidewall 13.

Instead of attaching the band 11 to the sidewall 13 by means of connecting bridges 17, a thin breakable ring of plastics material (not shown) may be used instead, and such a ring may have at least one thickened, stronger part serving to retain the band 11 on the sidewall 13 after the rest of the breakable ring has been broken. Such a ring would be moulded in one piece with the cap 10.

On its internal surface 18, the band 11 has four identical protrusions in the vicinity of the lower rim 19 of the band 11. Each protrusion comprises an elongated, inward projection 22 and the projections 22 are spaced at equal intervals around the internal surface 18 of the band 11.

Each projection 22 is formed on an internal strengthening rib 23 on the band 11 and the internal diameter of the rib 23 is greater than the largest diameter of a bead on a container which the projections 22 cooperate with, as will be described below so that, in the case of the present closure, the rib 23 cannot contact the bead and therefore cannot cooperate in retaining the closure on a container by engagement under the bead.

Extending downwardly from each projection 22 to the lower rim 19 of the band 11 (and thus located inside the band 11) is an extension 24. Each extension 24 has a smooth outwardly and downwardly inclined surface 25 which merges smoothly with the surface of the projection 22. Each projection 22 extends in the general direction around the band 11 but has a longitudinal axis 26 (FIG. 3) inclined to the circumferential direction 27 of the band at a small angle, for example from 1° to 5°, preferably 2° as in the present case. Thus, each projection 22 has a helical configuration in relation to the band 11, but all the projections 22 lie at the same horizontal level inside the band and thus each lies on a separate helix.

Figure 4:
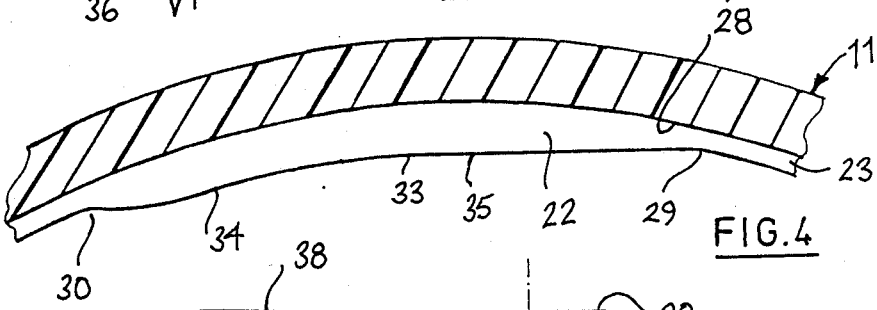
FIG. 4 is a section on the line IV—IV of FIG. 3.
Figure 6:
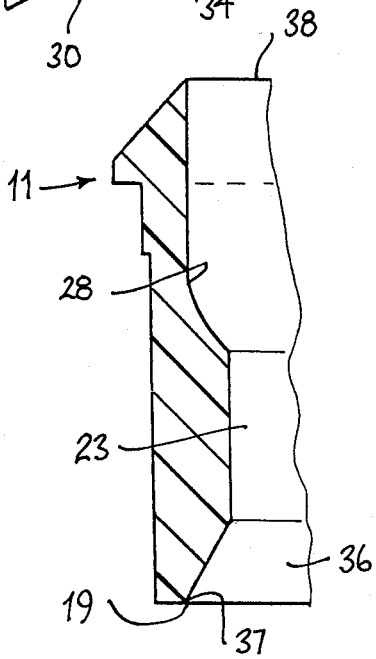
FIG. 6 is a section on the line VI—VI of FIG. 3.

The configuration of the screw-thread formed internally on the sidewall 13 is such that the closure is screwed onto a container by turning it in a clockwise direction, when viewing from above (that is from outside) the end wall 12. This is the usual configuration for such a screw-thread. The leading end of each projection 22, determined in relation to the action of screwing the closure onto a container, merges smoothly with the immediately preceding part of the band 11 and increases gradually and smoothly in height (that is in the distance by which it projects inwardly from the inner surface 28 of the band 11) in a rearward direction. This can be seen in FIG. 4 where the height of the strengthening rib 23 fromt he surface 28 of the band 11 is 0.25 mm and the projection increases from this height to a height of 0.65 mm over one quarter of its length from its leading end 29. Halfway along its length, at the point 33, the height of the projection 22 has reached its maximum of 0.75 mm and it decreases from this level slowly at first and then more rapidly to merge smoothly at its trailing end with the strengthening rib 23. The decrease starts at a point 34 a distance of approximately 1.75 mm from the trailing end 30 of the projection 22. The total length of the projection 22 is approximately 9 mm and the distance of 1.75 mm thus represents approximately 20% of the length of the projection 22. At a distance of 20% from its leading end 29, the height of the projection 22 is 0.60 mm. Over a distance of approximately 3.5 mm from its leading end 29 to the point 35, that is over approximately 40% of its length, the innermost edge (in relation to the axis of the closure) of the projection 22, shown in FIG. 4, is a straight line which is part of a chord of a circle lying in the inner surface 28 of the band 11.

The lower rim 19 of the band 11 is internally chamfered so that the chamfer surface 36 extends upwardly and inwardly from the lowermost, inner extremity 37 of the band 11 and merges with the surface of the lower part of the extension 24.

The helical configuration of each projection 22 is in the same sense as the helix of the screw-thread 15 on the closure and this and the fact that the leading end of each projection merges smoothly with the immediately preceding part of the band 11, in fact with the surface of the rib 23, facilitates the application of the closure to a container and in particular assists the projections 22 on the band 11 to ride over an outwardly projecting bead on the container without breaking the band 11 or the connecting bridges 17. This action may be assisted in that the helical configuration of each projection 22 causes the band 11 to lag slightly with respect to the cap 10, due to twisting of the bridges 17 when the closure is applied to a container and the projections 22 come into contact with a projecting bead on the container. Such a rotation may allow the upper rim 38 of the band 11 to come into contact with the lower rim 16 of the sidewall 13 and thus provide support for the bridges. Additionally since only part of the innermost surface of each projection 22 comes into contact with the surface of the bead on the container at any one time during first application of the closure, it is believed that the frictional force resisting application of the closure may be reduced.

Figure 5:
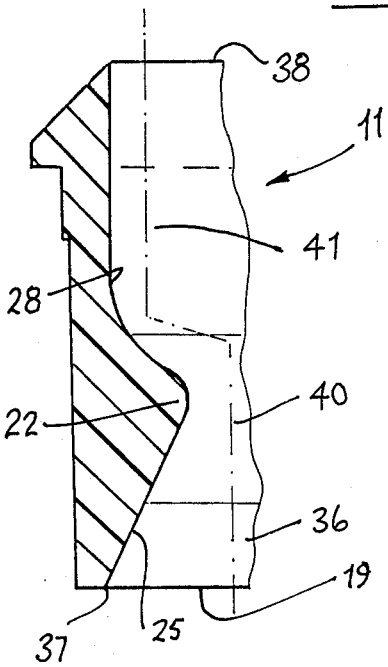
FIG. 5 is a section on the line V—V of FIG. 3.

The container neck 40 and its bead 41 are shown in chain lines in FIG. 5 in the position existing after the closure has been applied to the neck 40 but before first removal therefrom.

When the closure comes to be removed from the container for the first time, the projections 22 are not assisted over the bead on the container by their helical configuration. Rather the reverse is the case and there is no support available from the lower rim 16 of the sidewall 13. Thus there is every likelihood that bridges 17 and/or the band 11 will break.

To ensure the possibility of support being afforded to the band and connecting bridges on slight rotation of the band, desirably, as in the closure shown in FIGS. 1 to 6, the upper rim 38 of the band is close to the lower rim 16 of the sidewall 13 and in fact is spaced from the lower rim 16 by no more than 2 mm for a 38 mm diameter beverage container closure, or in smaller closures by no more than 1 mm, but should not be less than 0.5 mm.

FIGS. 7 and 8 show in partial longitudinal section and perspective view, respectively, a modified form of closure in accordance with the invention. For convenience, the same reference numerals have been used in FIGS. 7 and 8 to designate equivalent features to those shown in the embodiment of FIGS. 1 to 6.

The closure of FIGS. 7 and 8 has an increased number of bridges 17 linking the cap 10 to the tamper-indicating band 11 but more importantly has a plurality of (in this case four) lugs 39, one located centrally between each helical protrusion 22. The lugs 39 (which in the illustrated case—on a 38 mm diameter beverage container closure-each have a radial extension "x" of some 3 mm) are designed to engage on the bead 41 of the container 40 as the closure cap 10 is being removed from the container. By virtue of this engagement the lugs 39 provide support for the band 11 and prevent it distorting towards a polygonal shape (in this case a "square" shape) in which the protrusions 22 could ride over the bead 41 as the cap 10 is removed. The provision of the lugs 39 thus gives a more reliable tamper-indication.

The helical protrusion 22 is shown dotted in FIG. 7 to give an indication of the relative shapes of the protrusion 22 and the lug 39, although, of course, these features are, in reality, spaced-apart around the band 11.

What is claimed is:

1. In a closure for a container, including a tamper-indicating band with internal protrusions for engagement under a bead on a container to prevent removal of the closure from the container after application thereto without breaking the tamper-indicating band, the improvement of forming each internal protrusion on the tamper-indicating band as an elongated, inward projection extending in a general direction around the band and having a longitudinal axis inclined to the circumferential direction of the band at a small angle so that each projection has a helical configuration in relation to the tamper-indicating band, and of forming the leading end of each projection, as determined by the action of screwing the closure onto a container, so that it merges smoothly with the immediately preceding part of the tamper-indicating band and increases gradually and smoothly in height in a rearward direction, each projection having a downward extension with a smooth, outwardly and downwardly inclined surface, extending to, or close to, the lower rim of the tamper-indicating band.

2. A closure as claimed in claim 1, wherein the inward projections are formed on an internal strengthening rib on the tamper-indicating band, and the inner diameter of the rib has a diameter at least equal to the largest diameter of the bead on the container to which the closure is intended to be fitted, whereby the rib does not engage under the bead when the closure is applied to the container.

3. A closure as claimed in claim 1, wherein the lower rim of the tamper-indicating band is internally chamfered so that its inner surface extends upwardly and inwardly from the lowermost, inner extremity of the band and the chamfer surface merges with the surfaces of the lower parts of the downward extensions of said projections.

4. A closure as claimed in claim 2, wherein the lower rim of the tamper-indicating band is internally chamfered so that its inner surface extends upwardly and inwardly from the lowermost, inner extremity of the band and the chamfer surface merges with the surfaces of the lower parts of the downward extensions of said projections.

5. A closure as claimed in claim 1, wherein between each pair of protrusions on the tamper-indicating band is located an inwardly extending lug of smaller depth than the protrusions and arranged, during removal of the closure from the container to which it is intended to be fitted, so that it engages the bead on the container and supports the tamper-indicating band against distortion.

6. A closure as claimed in claim 2, wherein between each pair of protrusions on the tamper-indicating band is located an inwardly extending lug of smaller depth than the protrusions and arranged, during removal of the closure from the container to which it is intended to be fitted, so that it engages the bead on the container and supports the tamper-indicating band against distortion.

7. A closure as claimed in claim 3, wherein between each pair of protrusions on the tamper-indicating band is located an inwardly extending lug of smaller depth than the protrusions and arranged, during removal of the closure from the container to which it is intended to be fitted, so that it engages the bead on the container and supports the tamper-indicating band against distortion.

8. A closure as claimed in claim 5, wherein there are four protrusions and four lugs.

9. A closure as claimed in claim 1, wherein the tamper-indicating band is connected to a screw-threaded cap of the closure by a plurality of bridges, at least one of which is stronger than the others.

10. A closure as claimed in claim 1, wherein the closure is injection moulded in one piece from synthetic plastics material and contains a solidified flowed-in gasket material which will form a sealing conjunction with the mouth of a container to which the closure is applied.

* * * * *